US008991945B2

(12) United States Patent
Grill

(10) Patent No.: US 8,991,945 B2
(45) Date of Patent: Mar. 31, 2015

(54) MERCHANDISER INCLUDING ACCESSIBLE CANOPY

(71) Applicant: Hussmann Corporation, St. Louis, MO (US)

(72) Inventor: Michael A. Grill, Overland, MO (US)

(73) Assignee: Hussmann Corporation, Bridgeton, MO (US)

( * ) Notice: Subject to any disclaimer, the term of this patent is extended or adjusted under 35 U.S.C. 154(b) by 95 days.

(21) Appl. No.: 13/794,916

(22) Filed: Mar. 12, 2013

(65) Prior Publication Data

US 2014/0265755 A1 Sep. 18, 2014

(51) Int. Cl.
*A47F 3/00* (2006.01)
*F25D 23/06* (2006.01)

(52) U.S. Cl.
CPC ..... *F25D 23/061* (2013.01)
USPC ..... 312/116; 62/246

(58) Field of Classification Search
USPC ..... 312/114, 116, 137, 223.6; 174/68.1, 174/480, 481; 62/246, 251, 256
See application file for complete search history.

(56) References Cited

U.S. PATENT DOCUMENTS

| | | | | |
|---|---|---|---|---|
| 2,021,233 | A | 11/1935 | Fink | |
| 2,492,695 | A * | 12/1949 | Henderson | 62/252 |
| 4,602,827 | A * | 7/1986 | Casanova | 312/116 |
| 4,942,271 | A | 7/1990 | Corsi et al. | |
| 4,977,754 | A * | 12/1990 | Upton et al. | 62/248 |
| 5,508,898 | A | 4/1996 | McGovern | |
| 5,942,729 | A | 8/1999 | Carlson, Jr. et al. | |
| 6,010,227 | A | 1/2000 | Crown et al. | |
| 6,029,411 | A | 2/2000 | Richardson | |
| 6,107,575 | A | 8/2000 | Miranda | |
| 6,323,421 | B1 | 11/2001 | Pawson et al. | |
| 6,325,523 | B1 | 12/2001 | Santosuosso | |
| 6,367,223 | B1 | 4/2002 | Richardson et al. | |
| 6,578,301 | B1 | 6/2003 | Ericson | |
| 6,972,367 | B2 | 12/2005 | Federspiel et al. | |
| 7,240,506 | B2 | 7/2007 | Grassmuck et al. | |
| 7,284,876 | B2 | 10/2007 | Ericson | |
| 7,612,300 | B2 | 11/2009 | Owens et al. | |
| 7,696,434 | B2 | 4/2010 | Ruddick | |
| 8,183,471 | B2 | 5/2012 | Handler | |
| 2005/0263309 | A1 | 12/2005 | VanderVelde et al. | |
| 2006/0242981 | A1 * | 11/2006 | Grassmuck et al. | 62/246 |
| 2009/0032651 | A1 * | 2/2009 | Sayres | 248/68.1 |

FOREIGN PATENT DOCUMENTS

| | | |
|---|---|---|
| GB | 2170893 | 8/1986 |

* cited by examiner

*Primary Examiner* — James O Hansen
(74) *Attorney, Agent, or Firm* — Michael Best & Friedrich LLP

(57) ABSTRACT

A refrigerated merchandiser including a case defining a product display area. The case includes a canopy defining an electrical raceway, and a panel defining aesthetic fascia for the canopy. The panel is coupled to the canopy and movable between a first position enclosing the electrical raceway and a second position providing access to the electrical raceway. The panel is self-supported in the second position.

9 Claims, 6 Drawing Sheets

MERCHANDISER INCLUDING ACCESSIBLE CANOPY

BACKGROUND

The present invention relates to merchandisers and, more particularly, to merchandiser canopies.

Existing merchandisers typically have electrical components positioned in the base near the surface on which the merchandiser is supported. In addition, electrical wiring is frequently routed through the merchandiser in the same general area. However, access to the electrical components wiring for servicing can be difficult because access is provided very close to the support surface. As a result, a technician will likely have to lie prone on the support surface to access this location.

SUMMARY

In one construction, the invention provides a refrigerated merchandiser including a case defining a product display area. The case includes a canopy defining an electrical raceway, and a panel defining aesthetic fascia for the canopy. The panel is coupled to the canopy and movable between a first position enclosing the electrical raceway and a second position providing access to the electrical raceway. The panel is self-supported in the second position.

In another construction, the invention provides a refrigerated merchandiser including a case defining a product display area. The case includes a canopy defining an electrical raceway. The merchandiser includes a first panel defining aesthetic fascia for the canopy. The first panel is coupled to the canopy and pivotable between a first position partially enclosing the electrical raceway and a second position providing access to the electrical raceway. The first panel self-supported in the second position. The merchandiser further includes a second panel defining aesthetic fascia for the canopy. The second panel is coupled to the canopy and pivotable between a first position partially enclosing the electrical raceway and a second position providing access to the electrical raceway, the second panel self-supported in the second position.

In yet another construction, the invention provides a refrigerated merchandiser including a case defining a product display area. The case includes a canopy defining an electrical raceway. The merchandiser includes a first panel defining aesthetic fascia for the canopy. The first panel is coupled to the canopy and pivotable between a first position partially enclosing the electrical raceway and a second position providing access to the electrical raceway. The first panel is also removable from the canopy at a third position between the first position and the second position. The merchandiser also includes a second panel defining aesthetic fascia for the canopy. The second panel is coupled to the canopy and pivotable between a first position partially enclosing the electrical raceway and a second position providing access to the electrical raceway. The second panel is also removable from the canopy at a third position between the first position and the second position.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways.

DETAILED DESCRIPTION

Figure 1:
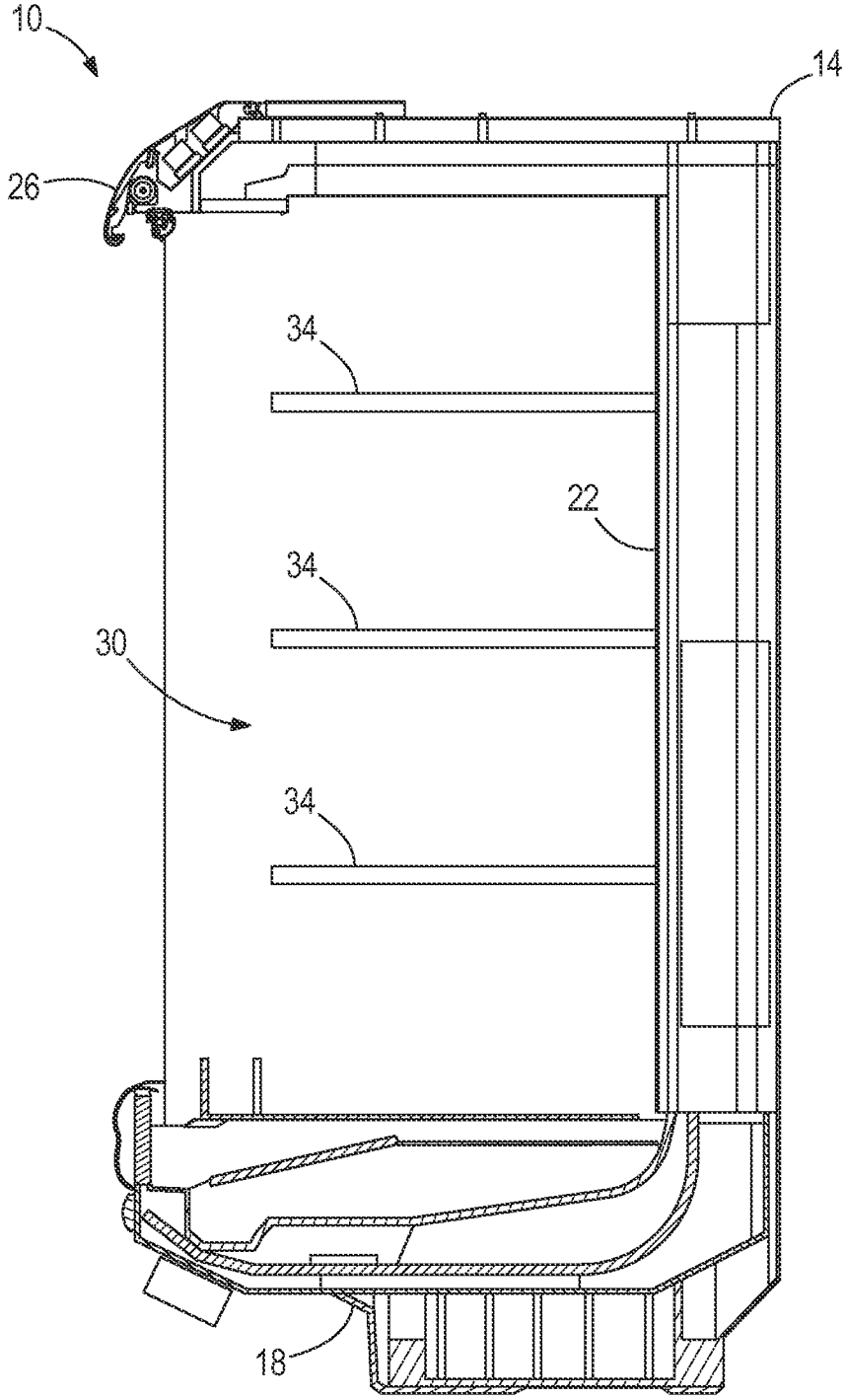
FIG. 1 is a section view of a merchandiser including a canopy embodying the invention.

FIG. 1 illustrates one construction of a merchandiser 10 that may be located in a supermarket or a convenience store or other retail setting (not shown) for presenting fresh food, beverages, and other food product (not shown) to consumers. The illustrated refrigerated merchandiser 10 includes a case 14 that has a base 18, a rear wall 22, and a canopy 26. The area partially enclosed by the base 18, the rear wall 22, and the canopy 26 defines a product display area 30 in which food product can be supported on shelves 34 and accessed from adjacent a front of the case 14. Although not shown, doors can be used to enclose the product display area 30.

The illustrated merchandiser 10 can be a refrigerated merchandiser that includes at least a portion of a refrigeration system (not shown) to provide refrigerated airflow to the product display area 30. As is generally understood, the refrigeration system includes an evaporator located within an air passageway internal to the case 14, and compressors compress a gaseous refrigerant and direct the compressed refrigerant to an exterior condenser where the refrigerant is cooled and condenses into a liquid refrigerant that is directed to the evaporator. Prior to reaching the evaporator, the liquid refrigerant is forced through an expansion valve converting the refrigerant into a two-phase fluid. The two-phase refrigerant absorbs heat from air being directed through the evaporator by a fan. The refrigerant generally leaves the evaporator in a superheated condition and is routed back to the compressor for recycling. The cooled air exiting the evaporator is directed through the remainder of the air passageway and is introduced into the product display area 30, where it will remove heat from the displayed food products and maintain the food products at the desired temperature.

Figure 2:
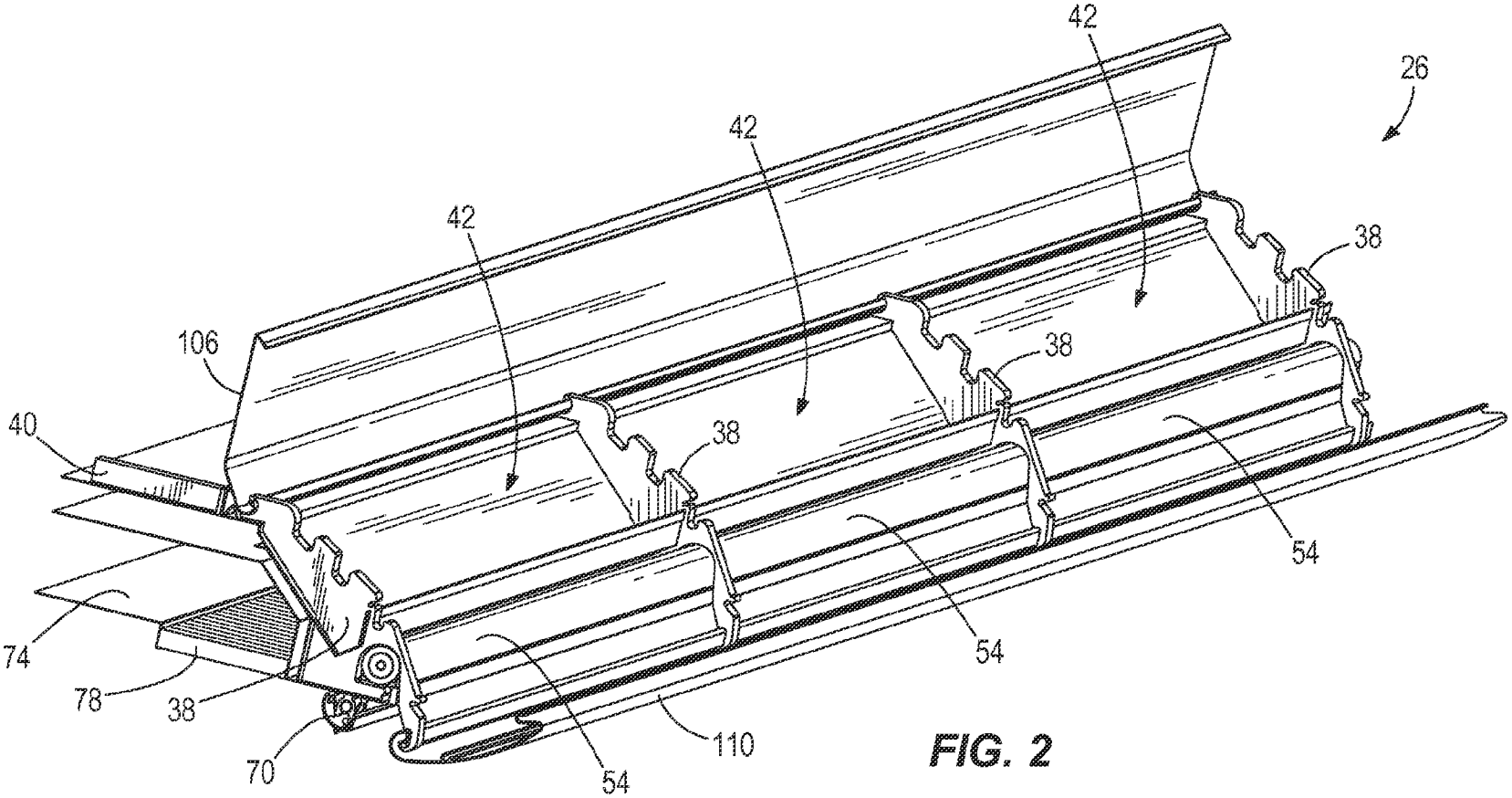
FIG. 2 is a perspective view of the canopy illustrating access panels in an open position and canopy support members.
Figure 3:
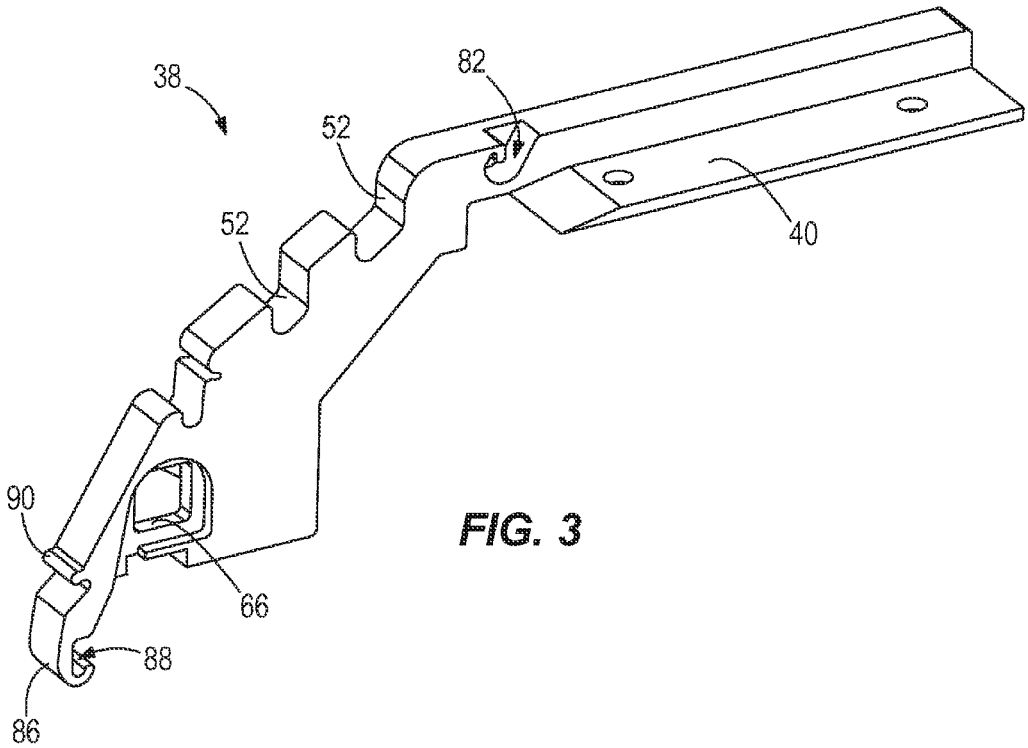
FIG. 3 is a perspective view of one canopy support member.
Figure 4:
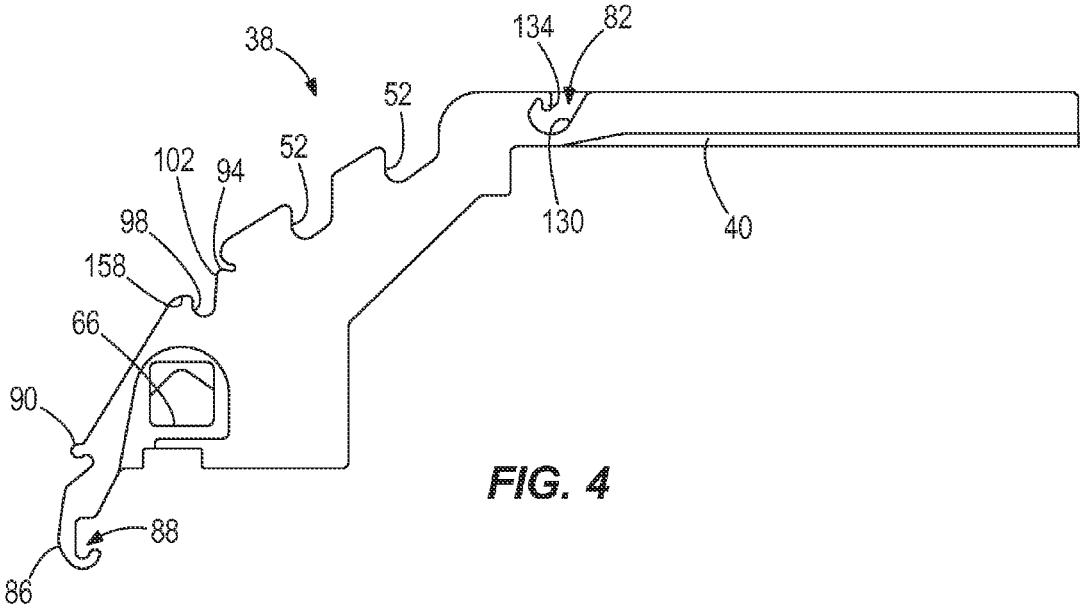
FIG. 4 is a side view of the canopy support member of FIG. 3.

With reference to FIGS. 2-8, the canopy 26 includes structural support members 38 that are coupled to the top of the canopy 26 via attachment portions 40. The illustrated support members 38 cantilevered off the top of the canopy 26 and are spaced apart from each other along the length of the canopy 26 and define compartments 42 between adjacent support members 38. As illustrated in FIGS. 2-4, each of the support members 38 defines an integrated or unitary canopy support that attaches or supports several merchandiser components within the canopy 26. With reference to FIGS. 2 and 3, an electrical raceway tray 46 is disposed in each compartment 42 to support electrical components and case-to-case wiring structure 50. Each support member 38 has recesses or openings 52 (two each are illustrated) that route the electrical wiring through the support members 38 while positioning the wiring in an accessible location where the wiring can be removed or installed without disassembling any part of the canopy.

The canopy 26 also has a night curtain 54, a light channel 58, and rear panel structure 62 that are supported by the support members 38 (e.g., via snap-fit arrangement). The night curtain 54 is disposed in each compartment 42 at a location slightly forward of and below the raceway tray 46. The support members 38 include a recess or pocket 66 that supports ends of the night curtain 54. The light channel 58 is coupled to a lower end of each support member 38 below and rearward of the night curtain 54, and supports a light assembly 70 that illuminates the product display area 30. The rear panel structure 62 is coupled to a rear side of the support members 38 and partially defines an air passageway 74 and an air outlet 78 within the canopy 26.

The support members 38 located adjacent the ends of the case 14 are flush with ends of the canopy 26 and can be coupled to support members (not shown) of adjacent merchandisers to provide a seamless case-to-case attachment between the adjacent canopies that is rigidly supported along its entire length. When doors are provided on the merchandiser 10, the doors can be partially coupled to the case 14 via the support members 38 (e.g., within a door mounting channel). Although the illustrated canopy 26 includes four spaced apart support members 38, fewer or more than four support members 38 can be provided depending on several factors (e.g., length of the canopy 26, amount of support needed or desired, etc.).

With reference to FIGS. 3 and 4, each support member 38 defines a first pivot recess 82 disposed adjacent the attachment portion 40 on an upper part of the support member 38. A lower end of the support member 38 has a hook-shaped extension 86 that defines a second pivot recess 88. The support member 38 also has a detent 90 that protrudes or extends outward from an upper side of the support member 38, and first and second attachment recesses 94, 98 disposed between the first pivot recess 82 and the detent 90. As illustrated, the first and second attachment recesses 94, 98 are located adjacent a central area of the support member 38 and are separated from each other by a bridge 102.

With reference to FIGS. 2 and 5-8, the support members 38 pivotably support a first cover or access panel 106 and a second cover or access panel 110 that enclose the compartments 42 and the components disposed in the compartments 42. The first and second panels 106, 110 define aesthetic fascia for the canopy 26 and are shaped to conform to the overall desired contour of the canopy 26. The illustrated first and second panels 106, 110 are coupled to the support members 38 within the first and second pivot recesses 82, 88 and are pivotable between respective first or closed positions (FIG. 5) and second or open positions (FIGS. 2 and 6) in an opposed pattern (i.e. away from each other, as compared to, for example, a tandem pattern) to provide access to the compartments 42 and the components inside the canopy 26.

Figure 5:
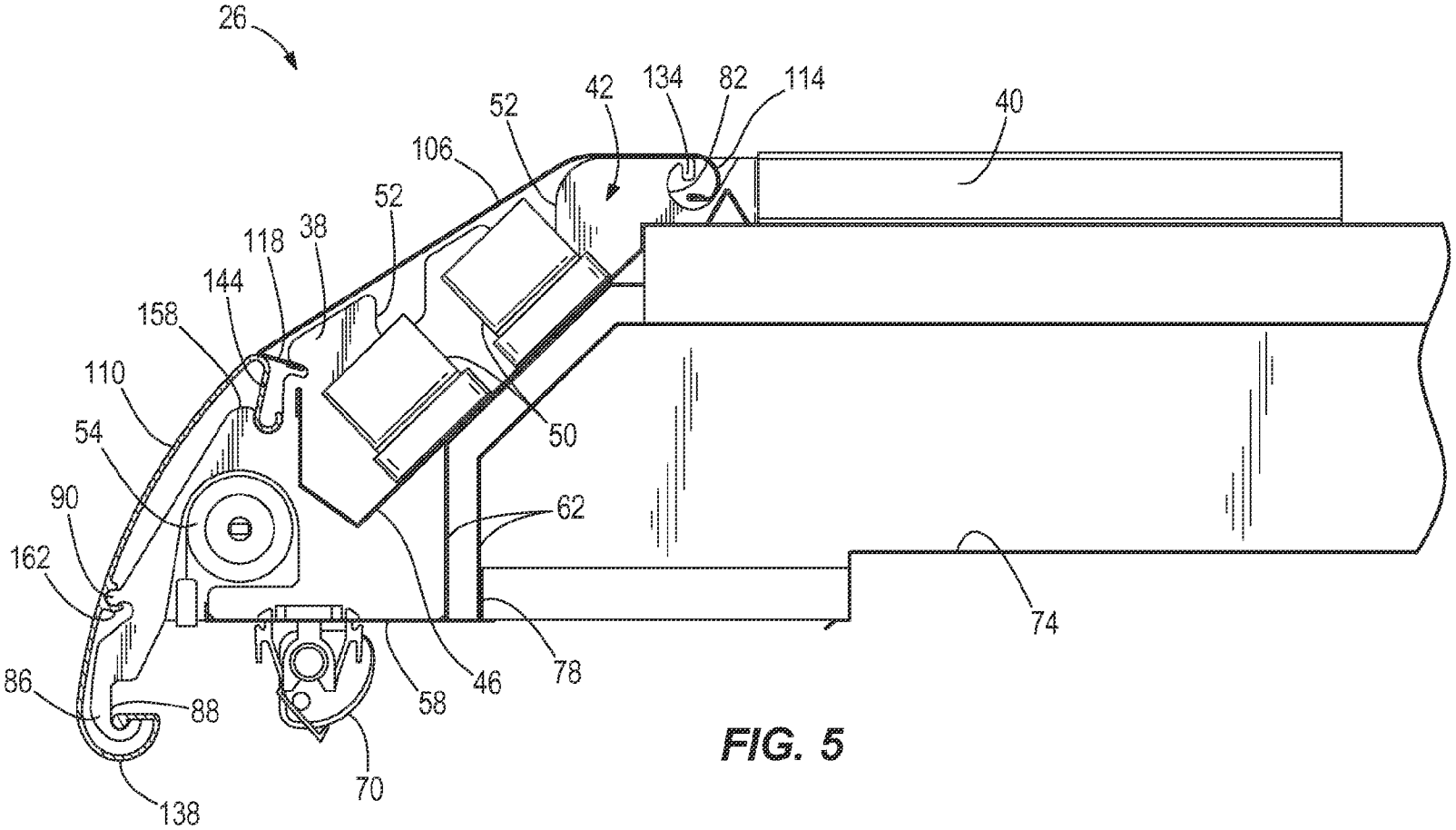
FIG. 5 is an enlarged section view of the canopy of FIG. 1 illustrating the access panels in a closed position.
Figure 6:
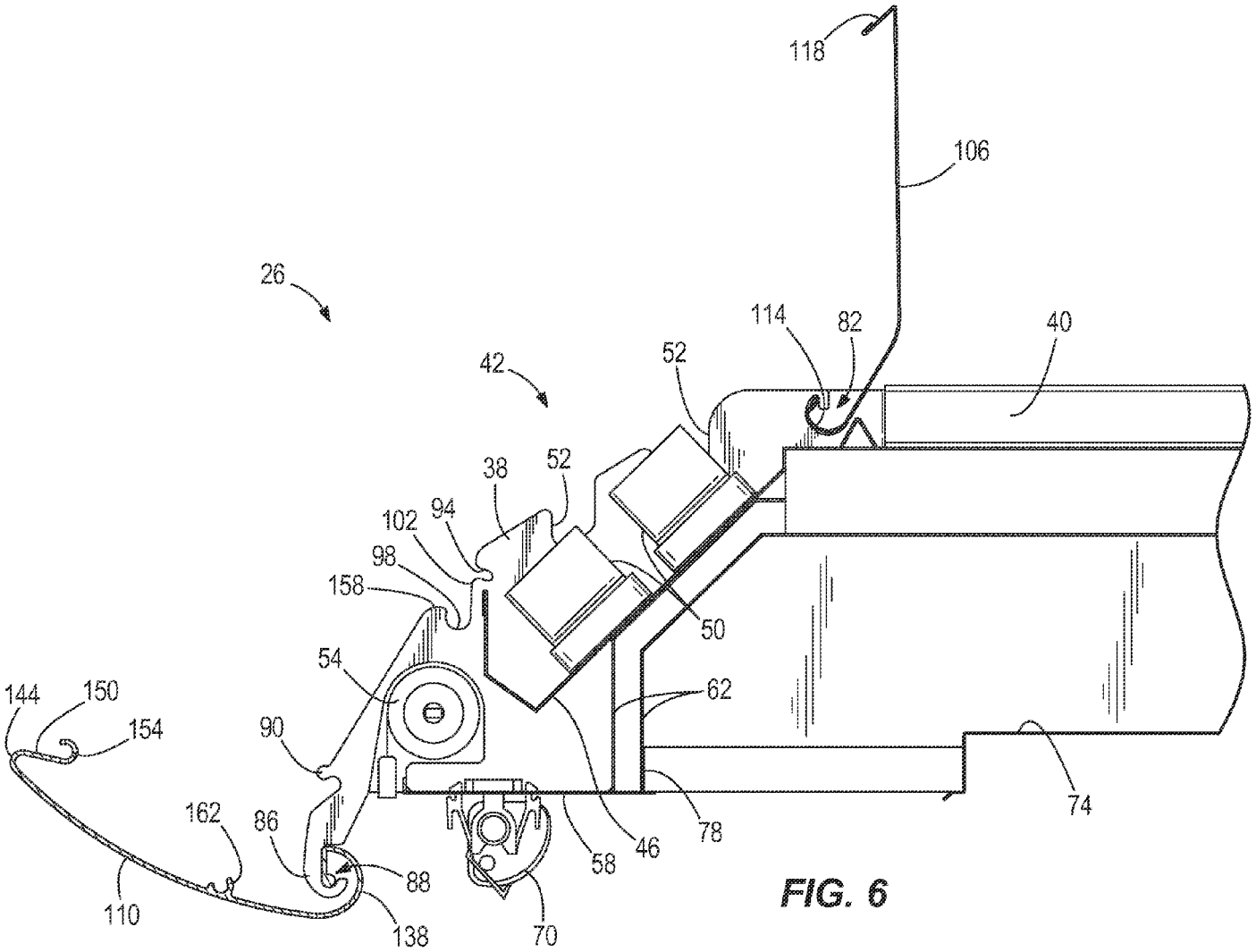
FIG. 6 is an enlarged section view of the canopy illustrating the access panels in the full open position.
Figure 7:
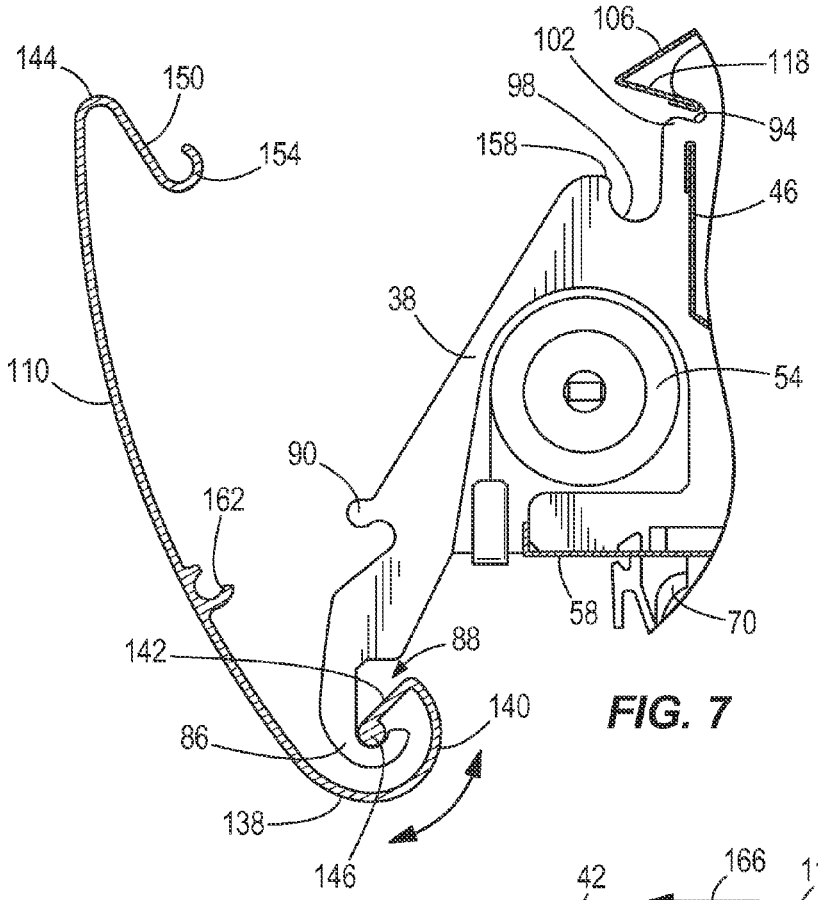
FIG. 7 is an enlarged section view of the canopy illustrating one of the access panels in a partial open position.

Referring to FIGS. 5-7, the first panel 106 (e.g., formed of sheet metal, thin plastic, composite, etc.) has a first end that is defined by a first pivot member 114 and a second end opposite the first end that is defined by a first retention member 118. The first pivot member 114 is hook-shaped and has a curved portion 122 and a planar portion 126 extending from the curved portion 122 to the end of the first panel 106. The first pivot member 114 is engaged with the first pivot recess 82 so that the first panel 106 can pivot relative to the remainder of the canopy 26. That is, the first pivot recess 82 and the first pivot member 114 cooperatively define a hinge about which the first panel 106 can move between the closed and open positions.

Figure 8:
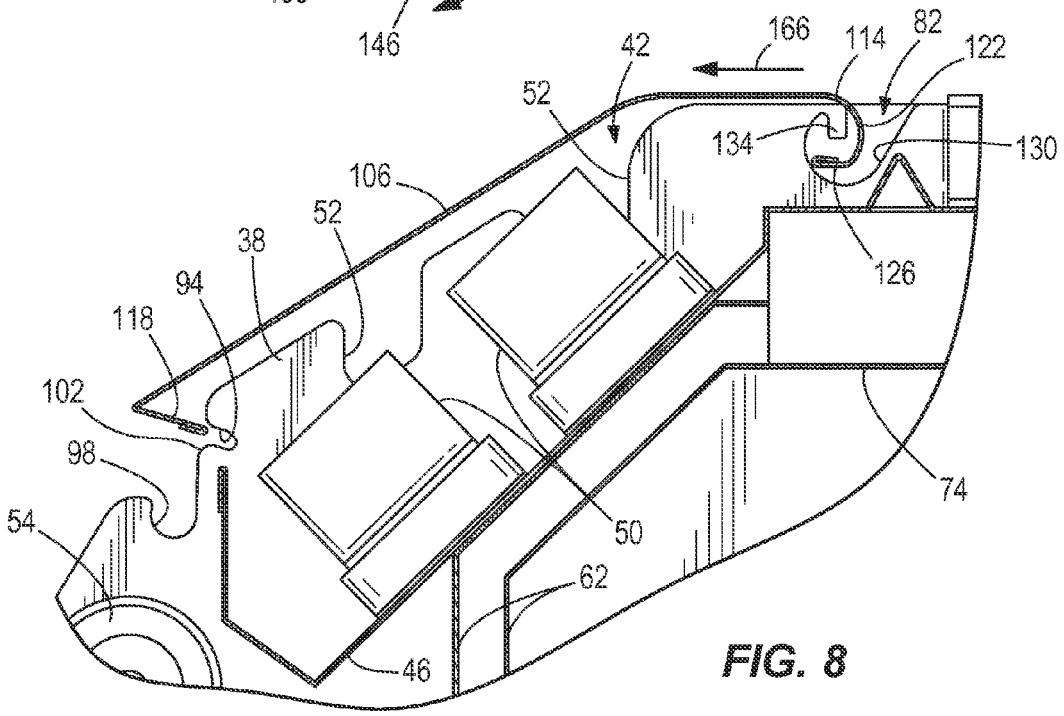
FIG. 8 is an enlarged section view of the canopy illustrating the other access panel in a partial open position.

As illustrated in FIG. 8, an end of the planar portion 126 is folded over on itself to strengthen the end of the first panel 106. Also, the first pivot recess 82 is shaped to include a ramp 130 that acts as a stop when the first panel 106 is opened. That is, the ramp 130 defines the farthest angle at which the first panel 106 can be oriented in the open position. As illustrated in FIG. 6, the ramp 130 is shaped so that the first panel 106 is in an over-center orientation in which the center of gravity of the first panel 106 is shifted rearward of the pivot point so that gravity assists with holding the first panel 106 in the open position. A retainer lip 134 is formed adjacent the opening to the first pivot member 114 to prevent inadvertent or undesired removal of the first panel 106 from the support members 38.

The first retention member 118 is defined by an acute bend in the forward end of the first panel 106 such that the first retention member 118 is bent back along the central portion of the first panel 106. The first retention member 118 is engaged with the support members 38 within the first attachment recess 94 to hold the first panel 106 in the closed position. As illustrated in FIG. 5, the first panel 106 is pushed rearward slightly to fully engage the first retention member 118 with the support member 38. In this position, the first pivot member 114 is positioned slightly rearward (i.e. spaced from) the first pivot recess 82. If necessary, the first retention member 118 can flex as it is oriented in the first attachment recess 94.

With reference to FIGS. 5-7, the second panel 110 (e.g., formed of sheet metal, thin plastic, composite, etc.) has a first end that is defined by a second pivot member 138 and a second end opposite the first end that is defined by a second retention member 144. The second pivot member 138 is hook-shaped and has a curved portion 140 and a planar portion 142 that is engaged with the second pivot recess 88 so that the second panel 110 can pivot relative to the extension 86. That is, the extension 86 and the second pivot member 138 cooperatively define a hinge about which the second panel 110 can move between the closed and open positions. As illustrated in FIGS. 5-7, an end of the planar portion 142 has a ball-shaped element 146 that is cupped by the second pivot recess 88 and that defines a pivoting axis for the second panel 110.

In the closed position, the ball-shaped element 146 is disposed in the second pivot recess 88 and the planar portion 142 rests on an end of the hook-shaped extension 86. As shown in FIG. 5, the second retention member 144 is coupled to the support members 38 by snap-fit engagement within the second attachment recess 98. The second retention member 144 has a spring-like engagement element 150 that is formed by an acute bend in the relatively thin first panel 106 and a hook-like feature 154 disposed on the end of the first panel 106. The hook-like feature 154 is flexibly engaged with the support members 38 within the second attachment recess 98 due to the spring-like engagement element 150. That is, the hook-like feature 154 is flexibly engageable with a lip 158 on the support members 38 to provide a small amount of resistance when opening or closing the second panel 110.

The illustrated second panel 110 also has a detent recess or element 162 that is engaged with the detent 90 when the first panel 106 is in the closed position to further assist with securing the second panel 110 to the canopy 26. When the illustrated second panel 110 is in the closed position, the planar portion 142 is engaged with a wall of the extension 86 to hold the second panel 110 in the open position. That is, the center of gravity of the second panel 110 is located forward of the pivot axis defined by the ball-shaped element 146 such that the weight of the second panel 110 is adequate to hold the panel 110 open.

The components and wiring supported by the canopy 26 can be installed before or after the first and second panels 106, 110 coupled to the canopy 26. To install the first panel 106, the first pivot member 114 is positioned adjacent the first pivot recess 82 so that the first panel 106 is angled generally toward a front of the case (toward the left as viewed in FIGS. 5 and 8). In this position, where the first panel 106 is closer to the closed position than the open position, the first pivot member 114 can engage the first pivot recess 82 by dropping the planar portion 126 into the recess 82 in a such a way that the end of the first panel 106 is very close to or brushes against the retainer lip 134. The first panel 106 can then be pulled forward (in the direction of arrow 166 in FIG. 8) until the rear end of the panel 106 is engaged with the wall defining the first pivot recess 82. In this position, the first retention member 118 is aligned with the first attachment recess 94. Thereafter, the first panel 106 can be pushed rearward so that the first retention member 118 is fully engaged with the support members 38 within the first attachment recess 94. These steps can be reversed to remove the first panel 106.

To install the second panel, the second pivot member 138 is positioned adjacent the second pivot recess 88 so that the second panel 110 is angled upward and slightly forward toward a front of the case 14 (see FIG. 7). In this position, the ball-shaped element 146 is slid over the edge of the extension 86 such that the portion of the second panel 110 on the opposite side of the extension 86 is positioned very close to or abutting the exterior side of the extension 86. The second panel 110 is then pulled in a direction that is generally forward and downward (relative to the case 14) so that the ball-shaped element 146 is engaged with the second pivot recess 88. The second panel 110 can then be pivoted toward the closed position or the open position. To close the second panel, the panel 110 is rotated clockwise (as viewed in FIGS. 6 and 7) until the second retention member 144 rests on the support members 38 and the detent 90 is engaged with the detent element 162. In this orientation, relatively light pressure on the second panel 110 adjacent the retention member will force the engagement element 150 over the lip 158 so that the hook-like feature 154 is engaged with the support members 38 within the second attachment recess 98. These steps can be reversed to remove the second panel.

When the first and second panels 106, 110 are in the closed positions, a slight interference fit is defined by the retention members 118, 144 to ensure that the panels 106, 110 106, 110 remain in the closed position. This fit also contributes to the aesthetic appeal of the canopy 26. To gain access to the compartments 42 (e.g., to service, install, or remove components or wiring), when the first and second panels 106, 110 are in the closed position, the first panel 106 can be disengaged from the support members 38 by applying pressure to the rear end of the first panel 106 to move the first panel 106 forward (i.e. toward a front of the case 14—in the direction of the arrow 166). With the first retention member 118 disengaged from the first attachment recess 94, the first panel 166 can be rotated or pivoted toward the open position about the hinge point defined by the first pivot recess 82 and the first pivot member 114.

The second panel 110 can be disengaged from the support members 38 after the first panel 106 is at least partially opened by applying a force on an inner side of the engagement element 150 so that the hook-like feature 154 flexes over the lip 158. Thereafter, the second panel 110 can be pivoted toward the open position about the hinge point defined by the second pivot recess 88 and the second pivot member 138. The process of opening the first and second panels 106, 110 can be reversed to close the panels 106, 110. Also, either of the first and second panels 106, 110 can be closed without first closing the other panel 106, 110, if desired.

The first and second panels 106, 110 are self-supported due to their respective over-center orientations when the first and second panels 106, 110 are in their respective open positions (see FIG. 6). With reference to the first panel 106, the ramp 130 cantilevers the first panel 106 in the over-center orientation while limiting further movement beyond the illustrated over-center orientation so that the first panel 106 remains in the open position until access to the interior of the canopy 26 is no longer desired. In some constructions, the ramp 130 can be removed such that the first panel 106 rests on top of the canopy 26. With regard to the second panel, the planar portion and the wall of the extension 86 are engaged with each other to cantilever the second panel 110 in the illustrated over-center open position until access to the interior of the canopy 26 is no longer desired. In this position, the second panel 110 does not obstruct viewability of the product display area 30. In some constructions, the second pivot member 138 can be shaped so that the second panel 110 is oriented downward (i.e. dangled from the extension 86).

Various features and advantages of the invention are set forth in the following claims.

The invention claimed is:

1. A merchandiser comprising:

a case defining a product display area including a canopy having an electrical raceway;

a first panel defining aesthetic fascia for the canopy, the first panel coupled to the canopy and pivotable between a first position partially enclosing the electrical raceway and a second position providing access to the electrical raceway, and the first panel self-supported in the second position; and a second panel defining aesthetic fascia for the canopy, the second panel coupled to the canopy and pivotable between a first position partially enclosing the electrical raceway and a second position providing access to the electrical raceway, the second panel self-supported in the second position, wherein the canopy includes a support member and each of the first panel and the second panel is pivotably coupled to the support member, wherein the support member defines a first pivot adjacent a first end and a second pivot adjacent a second end, wherein the first panel is pivotably coupled to the first pivot and the second panel is pivotably coupled to the second pivot, and the first panel and the second panel pivot toward each other to fully enclose the electrical raceway.

2. The merchandiser of claim 1, wherein each of the first panel and the second panel is separately hinged to the canopy.

3. The merchandiser of claim 1, wherein each of the first panel and the second panel are cantilevered relative to the support member in the respective second positions.

4. The merchandiser of claim 1, wherein the first panel includes a first longitudinal edge pivotably coupled to the support member and a second longitudinal edge detachably coupled to the support member.

5. The merchandiser of claim 4, wherein the second longitudinal edge is snap-fit to the support member.

6. The merchandiser of claim 4, wherein the second panel includes a first longitudinal edge pivotably coupled to the support member and a second longitudinal edge detachably coupled to the support member.

7. The merchandiser of claim 6, wherein the second longitudinal edge is snap-fit to the support member.

8. The merchandiser of claim 6, wherein the second longitudinal edges of the first panel and the second panel are engaged with each other.

9. A merchandiser comprising:

a case defining a product display area including a canopy having an electrical raceway;

a first panel defining aesthetic fascia for the canopy, the first panel coupled to the canopy and pivotable between a first position partially enclosing the electrical raceway and a second position providing access to the electrical raceway, the first panel removable from the canopy at a third position between the first position and the second position;

a second panel defining aesthetic fascia for the canopy, the second panel coupled to the canopy and pivotable between a first position partially enclosing the electrical raceway and a second position providing access to the electrical raceway, the second panel removable from the canopy at a third position between the first position and the second position, wherein the canopy includes a support member and each of the first panel and the second panel are cantilevered relative to the support member in the respective second positions, wherein the support member defines a first pivot adjacent a first end and a second pivot adjacent a second end, and wherein the first panel is pivotably coupled to the first pivot and the second panel is pivotably coupled to the second end, and the first panel and the second panel pivot toward each other to fully enclose the electrical raceway.

* * * * *